United States Patent [19]

Stewart

[11] Patent Number: 4,991,459

[45] Date of Patent: Feb. 12, 1991

[54] LINEAR MOTION CONTROL ARRANGEMENT

[75] Inventor: Richard F. Stewart, Middlesex, N.J.

[73] Assignee: White Consolidated Industries, Inc., Cleveland, Ohio

[21] Appl. No.: 529,111

[22] Filed: Jun. 25, 1990

Related U.S. Application Data

[63] Continuation of Ser. No. 279,654, Dec. 5, 1988, abandoned.

[51] Int. Cl.[5] ..... F16C 1/10

[52] U.S. Cl. ..... 74/500.5; 74/108; 74/89.2; 74/502; 74/503

[58] Field of Search ..... 74/108, 89.2, 500.5, 74/501.6, 502, 503, 501.5 R

[56] References Cited

U.S. PATENT DOCUMENTS

| | | | |
|---|---|---|---|
| 2,668,456 | 2/1954 | Meistrell | 74/503 |
| 2,706,913 | 4/1955 | Trossi | 74/89.2 |
| 3,046,799 | 7/1962 | Ash, II et al. | 74/108 X |
| 3,160,027 | 12/1964 | Waner | 74/501.6 |
| 4,059,021 | 11/1977 | Spanel et al. | 74/108 X |
| 4,092,689 | 5/1978 | Kaufholz | 74/502 X |
| 4,229,906 | 10/1980 | Pickles | 74/89.2 X |
| 4,275,503 | 6/1981 | Bergkvist | 74/108 X |
| 4,353,262 | 10/1982 | Talbot | 74/108 |
| 4,813,292 | 3/1989 | Boyko | 74/108 X |
| 4,837,650 | 6/1989 | Kawada | 74/89.2 X |

*Primary Examiner*—Vinh T. Luong

*Attorney, Agent, or Firm*—Pearne, Gordon, McCoy & Granger

[57] ABSTRACT

A control arrangement for translating substantially linear motion includes a control device, a controlled device, and a mechanical link interconnected between said control device and said controlled device. The mechanical link comprises a spring strip having an arcuate cross section. The control device comprises an arrangement for moving the strip substantially linearly in a given direction at the control device. The control arrangement further comprises at least one guide arrangement for bending the strip in at least one region between the control device and controlled device, to extend in a direction other than the given direction. The strip extends without support by lateral forces in at least one region between the control device and controlled device.

6 Claims, 4 Drawing Sheets

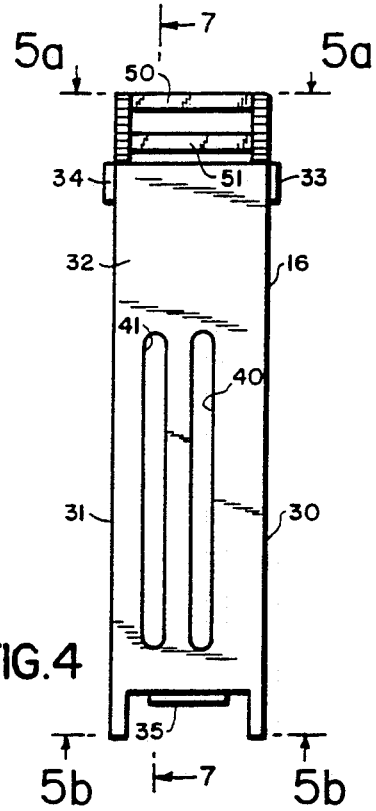
FIG.4
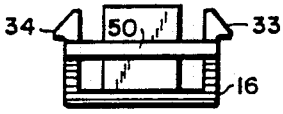
FIG.5a
FIG.5b
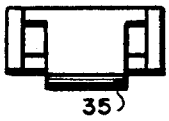
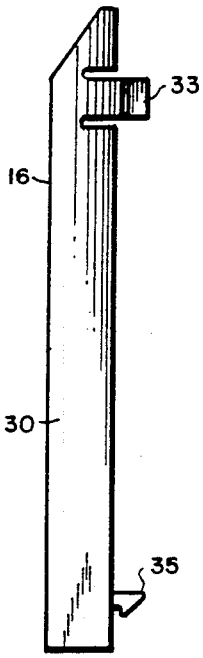
FIG.6
FIG.7
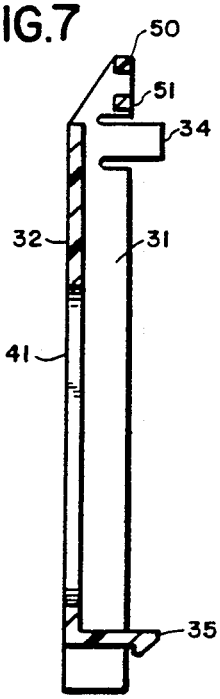
FIG.8
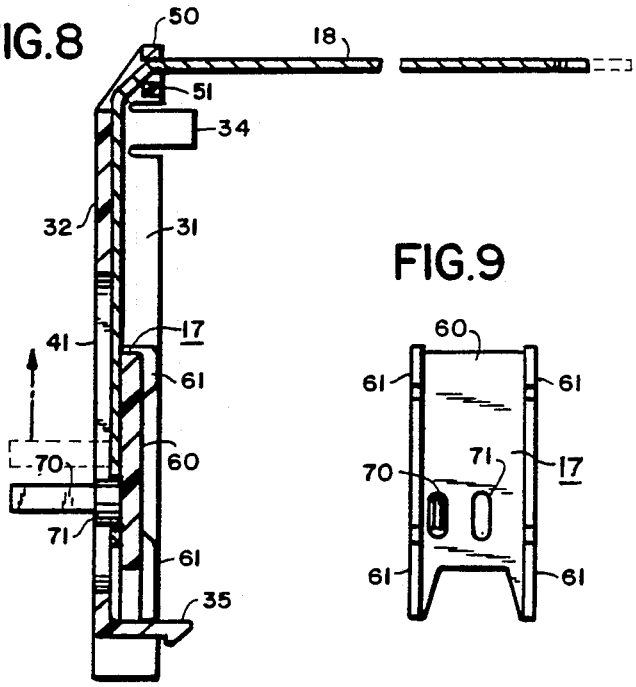
FIG.9

LINEAR MOTION CONTROL ARRANGEMENT

BACKGROUND OF THE INVENTION

This is a continuation of application Ser. No. 07/279,654, filed Dec. 5, 1988 now abandoned.

FIELD OF THE INVENTION

This invention is directed to the provision of a linear motion control arrangement, specifically a control arrangement enabling the linear mechanical control of devices, including a translation of the linear movement around corners or the like. While the invention as disclosed in the following paragraphs is shown to be especially adapted to enable the positioning of a pivoted vent door in an air conditioner by means of a linearly movable manual control at the front panel of the air conditioner, it will be apparent that this represents only one example of the use of the control arrangement of the invention, and that the scope of the invention is limited only by the claims following this disclosure.

DESCRIPTION OF THE PRIOR ART

Room air conditioners are frequently provided with a pivoted vent door positioned so that, when opened, external air may be introduced into the air conditioning system. Such vent doors are conventionally located in the air conditioner at some distance from the front panel, so that it is necessary to provide a mechanical control interconnecting the vent door and a front panel control. On many occasions, it is desirable to employ a linearly movable manual control on the front panel, so that the vent door may be readily opened to any desired extent. The structure of the air conditioners frequently does not permit a direct mechanical linkage between the vent door and the front panel control, so that more complex mechanical linkages must be employed. For example, a Bowden cable may be employed for this purpose. Such cables increase the expense of the apparatus, however, both in the cost of the cable itself and in the installation thereof.

The use of strips for transmitting force is known in the prior art, for example, in U.S. Pat. Nos. 2,284,517; 2,668,456; 2,912,878; and 3,160,027. Such strips have not heretofore been employed to exert two directional forces in a partially unguided course between a drive element and a driven element, where the strip extends around bends.

SUMMARY OF THE INVENTION

The present invention is therefore directed to the provision of an improved mechanical control arrangement permitting the linear, or substantially linear, control of a device in a simple and economical manner.

Briefly stated, the invention provides a control arrangement for translating linear motion in a first direction to substantially linear motion in a second direction, wherein the linkage between the input device and the device being controlled is comprised of a resilient strip having an arcuate cross section. The strip may be of a material such as spring steel, similar, for example, to a spring steel tape measure.

It is frequently observed, when employing a conventional spring steel tape measure, that the arcuate cross section tape is adapted to extend rigidly linearly for an extended distance, but that it may be readily bent so that the cross section in a region of the bend is no longer arcuate. In accordance with the invention, this characteristic is employed in order to enable the translation of linear or substantially linear movement in a first direction, i.e., movement of one end of the tape, for example, by manual control, to linear or substantially linear movement of the other end of the tape in a direction other than the direction of manual control. Thus, it has been observed that when a tape of the above type is bent in a given region, and guided at such a region, the linear movement of the tape may be translated. Such translation may, of course, be effected more than one time, with suitable guides at each bend of the tape, so that critical positioning of a device to be controlled is not necessary. Since the tape requires no support between the guided bent positions thereof, the control arrangement in accordance with the invention is inexpensive and easy to install.

It will be apparent, of course, that the invention may be employed for the translation of other than manual movement, and that a significant degree of diversion from purely linear movement, e.g., to control a pivoted door, is permissible, such diversion being herein included in the term "substantially" linear.

BRIEF DESCRIPTION OF THE DRAWINGS

In order that the invention may be more clearly understood, it will now be disclosed in greater detail with reference to the accompanying drawings, wherein:

FIG. 4 is a front view of the retainer of the control;

FIG. 5*a* is a top view of the retainer;

FIG. 5*b* is a bottom view of the retainer;

FIG. 6 is a side view of the retainer;

FIG. 7 is a longitudinal, cross-sectional view of the retainer taken along line 7—7 of FIG. 4;

FIG. 8 is a cross-sectional view of the retainer corresponding to the view of FIG. 7, but with the spring strip and actuator installed therein;

FIG. 9 is a front view of the actuator;

DESCRIPTION OF THE PREFERRED EMBODIMENTS

Figure 1:
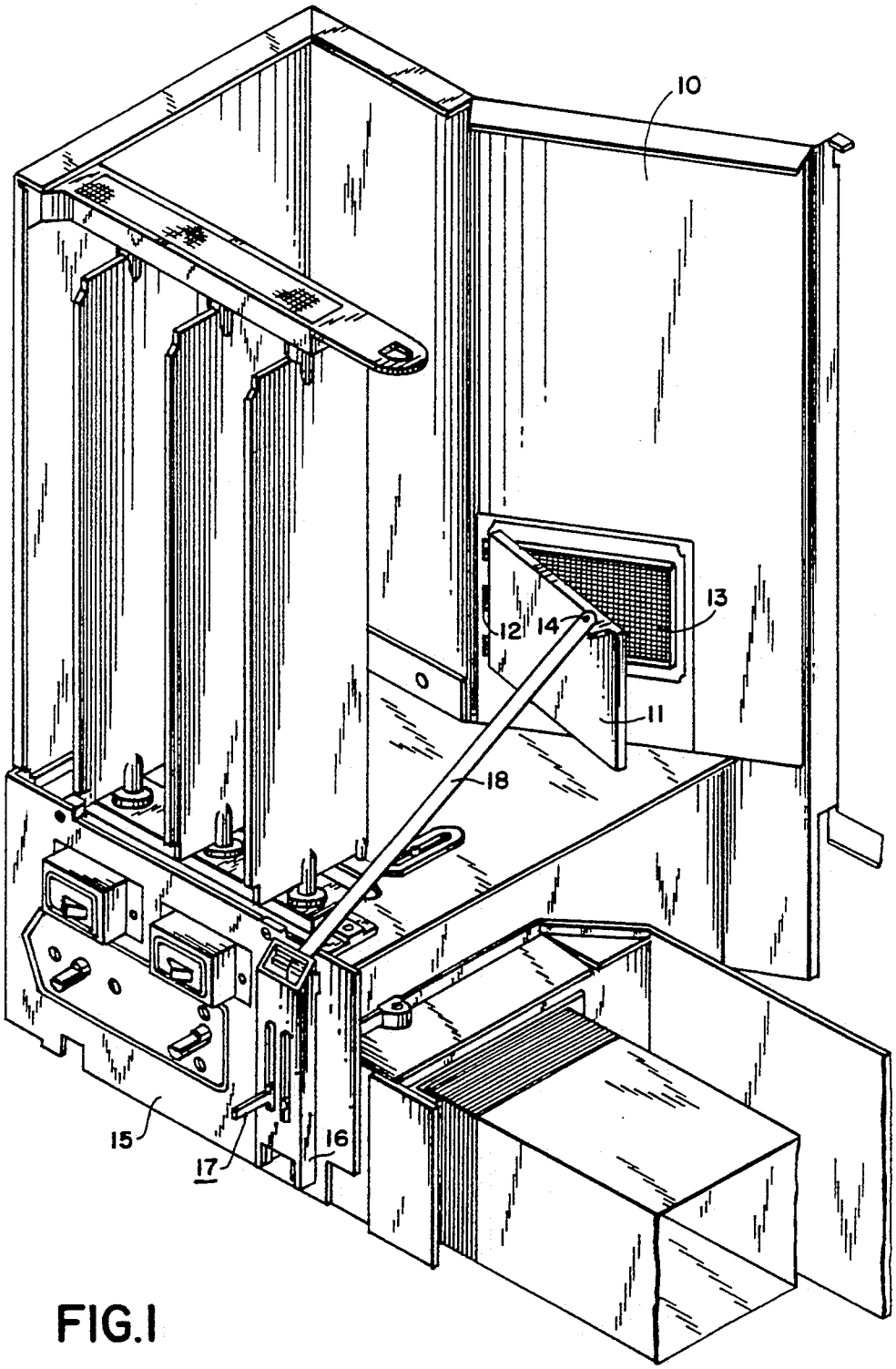
FIG. 1 is a perspective view of a portion of an air conditioner, illustrating the control in accordance with one embodiment of the invention.

Referring now to the drawings, and more particularly to FIG. 1, there is illustrated a portion of the control compartment of a room air conditioner without the conventional front cover thereon. The compartment has a rear wall 10, within which a pivoted door 11 is mounted for rotation, for example, about plastic hinges 12. The pivoted door is adapted to expose the interior of the air conditioner to outside air by way of a mesh window 13. As will be described, the pivoted door and mesh window may be formed of a common plastic molding. The door 11 is provided with a control pin 14 to enable it to be mechanically opened and closed.

The control compartment also has a control panel 15, and a retainer 16 for the control arrangement is mounted on the front of the control panel 15. The retainer 16 guides an actuator 17 for vertical manual movement. It is, of course, apparent that an ornamental knob (not shown) may be provided on the actuator 17 for a more pleasing appearance.

The control arrangement in accordance with the invention further comprises a spring strip 18 extending from the top of the retainer 16 rearwardly to engage the pin 14 of the door. As will be described, vertical movement of the actuator 17 by an operator results in generally rearward, substantially linear movement of the strip 18 as it emerges from the retainer, to enable control of the position of the door 11 by the actuator 17.

Since the further portions of the air conditioner as illustrated in FIG. 1 are not pertinent to the invention, they will not be specifically described herein.

As illustrated in FIGS. 2 and 4–8, the retainer 16 may be generally channel-shaped, having a pair of sides 30, 31 and a web 32 extending therebetween. Strap pins 33, 34 extend rearwardly from the upper ends of the sides 30 and 31, respectively, and a further snap pin 35 extends rearwardly from the bottom of the web 32 to enable the retainer to be readily snapped into appropriately positioned holes of the control panel. The sides 30, 31 extend downwardly beyond the end of the web for guiding the actuator 17 more firmly, as will be apparent. As seen more clearly in FIG. 4, the web 32 has a pair of parallel, longitudinally, vertically extending, spaced-apart slots 40–41. In addition, a bending guide is provided at the upper end of the retainer, comprised of vertically spaced-apart guide rods or bars 50–51 extending between the side walls 30, 31. The retainer 16 is thus formed in order to enable the guiding of the actuator 17 for vertical movement in a simple and economical manner.

Figure 2:
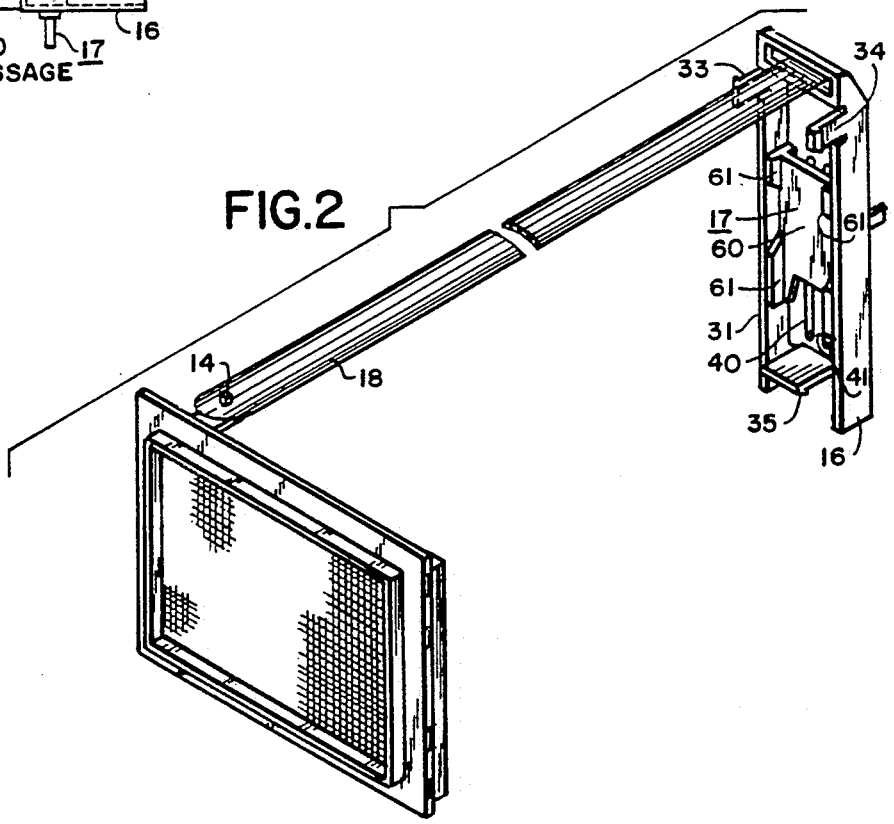
FIG. 2 is a perspective rear view of a portion of the control of FIG. 1.

The actuator 17 has a central web 60, as seen in FIGS. 2, 3, 8, and 9, extending between guide edges 61 extending in planes perpendicular to the web 60 at both sides thereof, so that the actuator has a generally I-shaped cross section. The guide edges 61 are adapted to slide along the linear surfaces of the side walls 30, 31 and have dimensions in the front-to-back direction of the retainer substantially equal to the front-to-back dimension of these side walls, as illustrated in FIGS. 2 and 8. Accordingly, when the actuator 17 is assembled in the retainer and the retainer is snapped onto a control panel, it is apparent that the retainer is restricted to linear movement parallel to the panel. The bottom of the web 60 of the retainer may be recessed, as illustrated in FIG. 9, to clear the snap pin 35, to enable increased vertical displacement of the actuator.

Figure 3:
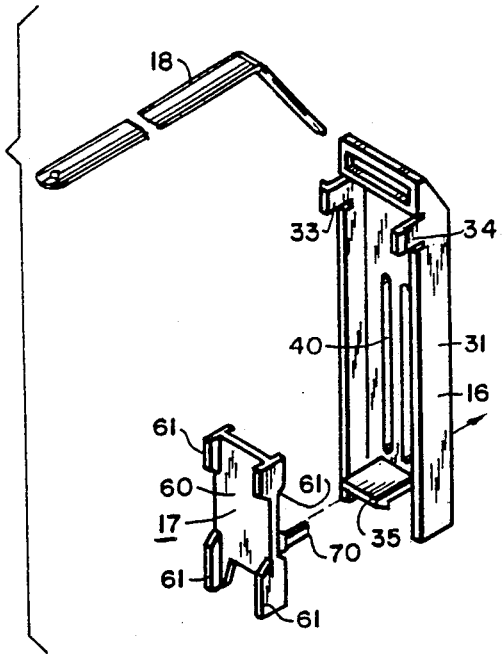
FIG. 3 is an exploded view of a portion of the control of FIG. 2.

As illustrated in FIGS. 3 and 8, a control pin 70 is provided extending from the front of the web 60, through the guide slot 41, to enable manual movement of the actuator. A similar projection 71 is provided extending forwardly from the web 60, for guidance in the slot 40 of the web of the retainer. The resilient strip 18, as illustrated in FIGS. 2 and 8, extends forwardly through the gap between the guide rods or bars 50, 51, bends downwardly against the back of the web 32 of the retainer, and is captured by the actuator 17 by the projection 71 extending through a hole in the strip 18.

The strip 18, as illustrated in FIG. 2, has an arcuate cross section, so that it extends in a straight condition at locations thereof that do not guide it around bends. Accordingly, it can transmit motion linearly in such regions without bending. The strip may be readily bent around guides, however, as illustrated in FIG. 8, so that the vertical linear motion of the actuator, urging the portion of the strip connected thereto in a vertical direction, may be translated around the guides into linear motion in a generally horizontal direction. The dashed lines in FIG. 8 show the strip 18 and the control pin 70 after the control pin has been moved in the direction of the arrow. As further illustrated in FIG. 3, the transverse cross section of the strip is substantially straightened in the region of the bend therein caused by the rods or bars 50, 51, so that the strip can bend easily. This phenomenon is inherent in the use of such strips, as is well known, for example, in the use of similarly shaped spring strips in the unrelated art of conventional tape measures. It must be observed, too, that, as illustrated in FIG. 2, it is not necessary that the generally horizontal portion of the strip move absolutely linearly, since the course of the generally horizontal portion of the strip 18 can readily follow direction variations as necessitated by the pivotal movement of the door.

While it is preferred that the strip 18 be of spring steel, it is apparent, of course, that it may alternatively be formed of other spring strip materials.

Figure 11:
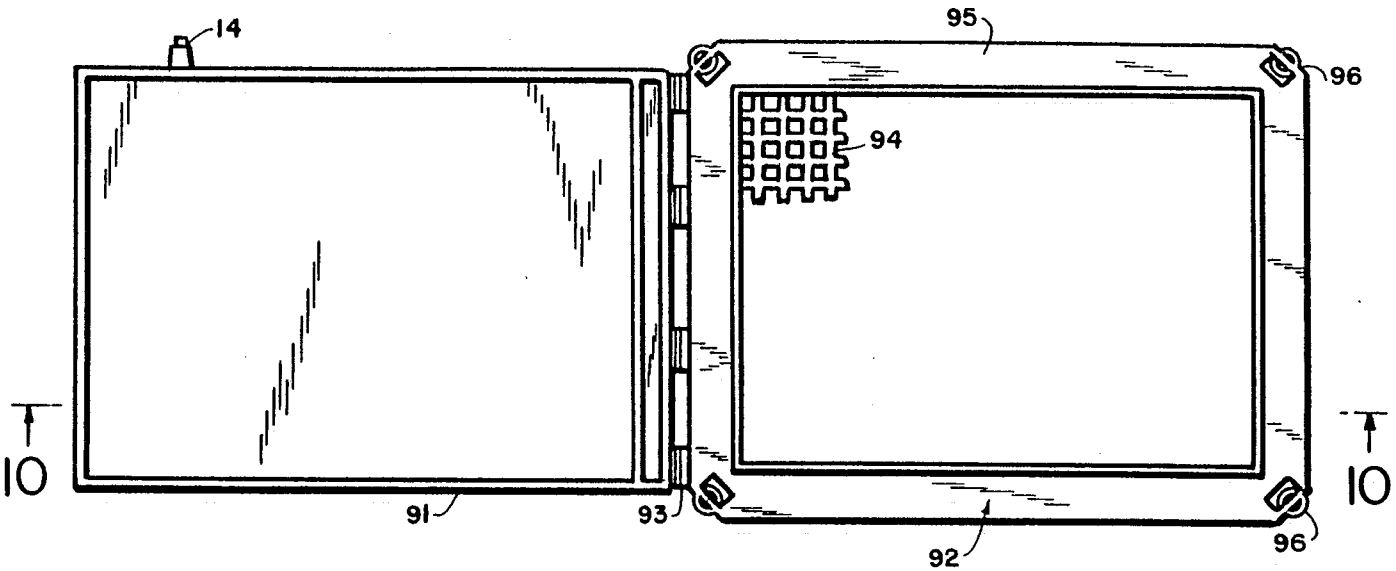
FIG. 11 is a front view of the hinge and door assembly of the device of FIG. 1.
Figure 10:
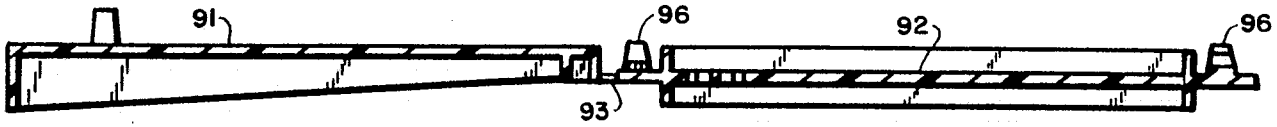
FIG. 10 is a top view of the hinge assembly of the device of FIG. 1.

The door assembly illustrated in FIG. 1 is shown in greater detail in FIGS. 10 and 11, this assembly preferably being formed of a unitary plastic member having a door portion 91 hinged to a base portion 92 by plastic hinges 93. The base portion 92 has a central portion 94 formed as a mesh for the passage of the air, and a mounting rim 95 with a mounting arrangement, e.g., snap pins 96, to enable it to be readily mounted to an aperture in a wall. This assembly may be fabricated by conventional techniques.

Figure 12:
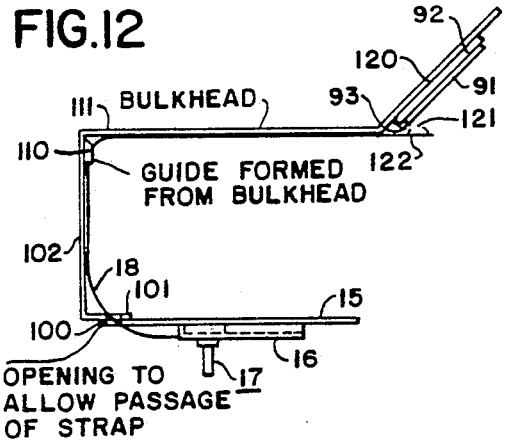
FIG. 12 is a top view of a modification of the control arrangement of FIG. 1.

FIG. 12 illustrates a modification of the control arrangement of FIG. 1, wherein the retainer 16 is mounted generally horizontally on the control panel 15 for horizontal linear movement of the actuator 17. With this arrangement, the retainer 16 itself is not provided with guide bars, and the strip 18 extending from one end thereof is directed to pass through an opening 100 in the flange 101 of a side wall 102 of the appliance, to be guided thereby along the inner surface of the vertical side wall 102 for movement in a front-to-back direction of the appliance. A further guide 110 is punched from the rear of the wall 102 to guide the strip 18 to follow the inner surface of a rear vertical wall 111, thereby guiding the strip 18 to move in a generally horizontal back-and-forth direction opposite to that of the actuator 17. The door assembly is mounted in a vertical wall 120 extending rearwardly at an angle from the wall 111. With this arrangement, a pin 121 is provided extending from the end of the door 91 at the edge thereof generally adjacent the hinge 93, and the rear end 122 of the strip 18 is pivotally mounted to this pin 121. For this purpose, for example, a tab 122 may be bent rearwardly from the strip having an aperture through which a downwardly extending end of the pin 121 projects.

It is apparent, of course, that the invention is not limited to the use of manual control and that the drive of the strip may be effected by other devices. The invention is especially advantageous for manual control, however, since it provides a good "feel" in the use of the control actuator due to the fact that the force required for movement of the actuator is extremely constant throughout its extent and smooth control is achieved.

Although the preferred embodiments of this invention has been shown and described, it should be understood that various modifications and rearrangements of the parts may be resorted to without departing from the scope of the invention as disclosed and claimed herein.

What is claimed is:

1. A control arrangement for translating movement, comprising a strip of resilient material having a bowed transverse cross section, whereby said strip extends substantially linearly in the absence of external forces thereon;

a driving element mounted for substantially linear movement in a first direction, said driving element being a manually movable actuator affixed to said strip at a first point of said strip for moving said strip longitudinally in said direction at said point;

a driven element mechanically coupled to said strip at a second point thereof to be mechanically moved by said strip, said driven element being a pivotally mounted door; and means for bending said strip in at least a first region between said driving element and driven element to extend in substantially different directions at the ends of said region, said strip being substantially unsupported in a second region thereof between said driving element and said driven element.

2. The control arrangement of claim 1, further comprising means for guiding said actuator for movement in said first direction.

3. A control arrangement for an appliance, comprising a control panel and a pivotally mounted internal element, said control arrangement comprising a manually movable actuator, a guide arrangement mounted on said control panel for guiding said actuator for movement in a given direction, a spring strip having an arcuate transverse cross section extending between said actuator and said internal element, and means for guiding said strip to bend to follow a non-linear path in at least one region thereof between said actuator and said internal element whereby said strip extends in substantially different directions at the ends of said region, at least another region of said strip between said actuator and said internal element being free of lateral forces, whereby movement of said actuator in said given direction moves said strip substantially linearly in said other region thereof in a second direction different from said given direction.

4. The control arrangement of claim 3, wherein said strip has first and second ends, said actuator being affixed to said first end, and wherein said guide arrangement comprises a retainer affixed to said control panel.

5. The control arrangement of claim 4, wherein said retainer has a channel-shaped transverse cross section with internal longitudinal walls, and said actuator has surfaces slidably guided by said longitudinal walls.

6. The control arrangement of claim 5, wherein said retainer has a pair of guide rods at one end thereof that are spaced apart in a direction parallel to the plane of said control panel, and said strip extends from said actuator to the space between said guide rods or bars, whereby said guide rods direct said strip to follow a path behind said control panel that is not parallel to the plane of said control panel.

* * * * *